US010046439B2

(12) United States Patent
Wendt-Ginsberg

(10) Patent No.: US 10,046,439 B2
(45) Date of Patent: Aug. 14, 2018

(54) VULCANIZED FIBER GRINDING TOOL

(71) Applicant: Dipl.-Ing. Guenter Wendt GmbH, Windeck (DE)

(72) Inventor: Marion Wendt-Ginsberg, Windeck (DE)

(73) Assignee: DIPL.-ING. GUENTER WENDT GMBH, Windeck (DE)

( * ) Notice: Subject to any disclaimer, the term of this patent is extended or adjusted under 35 U.S.C. 154(b) by 0 days.

(21) Appl. No.: 15/035,642

(22) PCT Filed: Nov. 11, 2014

(86) PCT No.: PCT/EP2014/003013

§ 371 (c)(1),
(2) Date: May 10, 2016

(87) PCT Pub. No.: WO2015/067377

PCT Pub. Date: May 14, 2015

(65) Prior Publication Data

US 2016/0279763 A1 Sep. 29, 2016

(30) Foreign Application Priority Data

Nov. 11, 2013 (DE) ..... 10 2013 017 962
Nov. 11, 2013 (DE) ..... 20 2013 010 146 U

(51) Int. Cl.
*B24D 13/14* (2006.01)
*B24D 13/18* (2006.01)
(Continued)

(52) U.S. Cl.
CPC ..... *B24D 13/14* (2013.01); *B24D 3/002* (2013.01); *B24D 3/28* (2013.01); *B24D 5/16* (2013.01);
(Continued)

(58) Field of Classification Search
CPC .. B24B 37/22; B24D 3/28; B24D 5/10; B24D 5/16; B24D 7/16; B24D 11/00;
(Continued)

(56) References Cited

U.S. PATENT DOCUMENTS 2,355,667 A * 8/1944 Ball ..... B24D 13/08 451/534
2,375,263 A * 5/1945 Upper ..... B24D 13/02 156/250
(Continued)

FOREIGN PATENT DOCUMENTS

DE 1853136 U 6/1962
DE 2121842 A1 12/1971
(Continued)

OTHER PUBLICATIONS

English language PCT International Search Report dated Jan. 30, 2015, received in corresponding PCT Application No. PCT/EP14/03013, 2 pgs.
(Continued)

*Primary Examiner* — Timothy V Eley
(74) *Attorney, Agent, or Firm* — Grossman, Tucker, Perreult & Pfleger, PLLC

(57) ABSTRACT

The invention relates to a vulcanized fiber grinding tool (1) comprising two vulcanized fiber grinding disks (2, 3) which are adhered to each other over the entire surface by means of an adhesive layer (4) arranged between the vulcanized fiber grinding disks (2, 3) such that the vulcanized fiber grinding disk (2, 3) outer faces provided with the grinding means point away from each other and the use of a support plate is not necessary.

20 Claims, 9 Drawing Sheets

Figure 1:
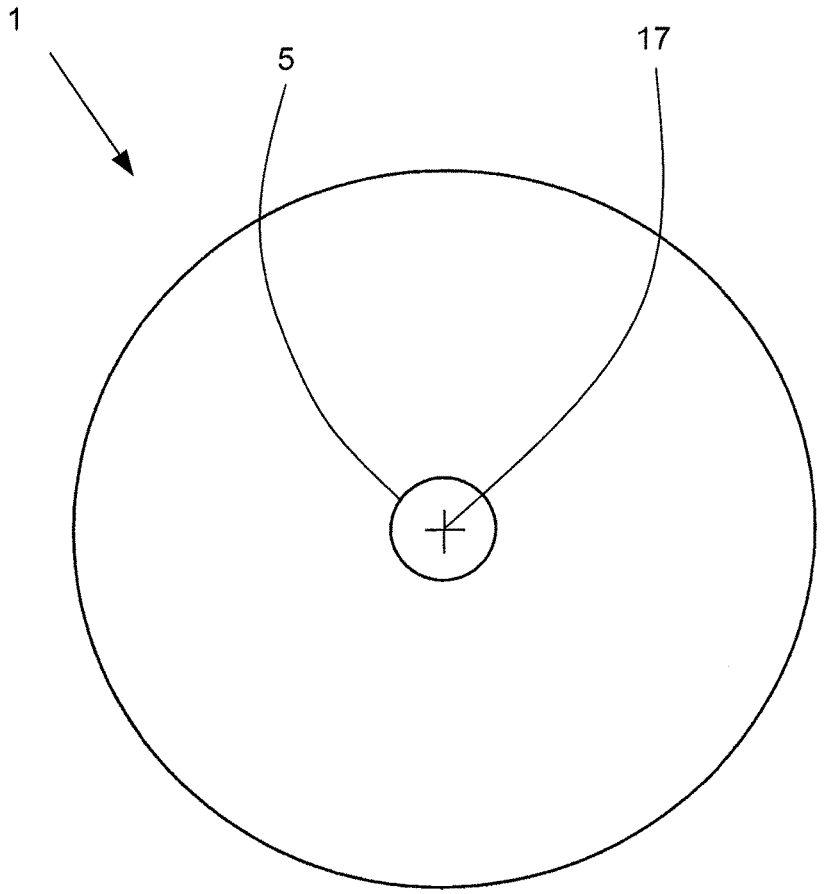

(51) Int. Cl.

| | |
|---|---|
| ***B24D 3/00*** | (2006.01) |
| ***B24D 3/28*** | (2006.01) |
| ***B24D 5/16*** | (2006.01) |
| ***B24D 7/16*** | (2006.01) |
| ***B24D 9/08*** | (2006.01) |
| ***B24D 18/00*** | (2006.01) |
| ***B24D 11/02*** | (2006.01) |
| *B24D 13/20* | (2006.01) |

(52) U.S. Cl.
CPC ..... *B24D 7/16* (2013.01); *B24D 9/085* (2013.01); *B24D 11/02* (2013.01); *B24D 13/18* (2013.01); *B24D 18/0045* (2013.01); *B24D 18/0072* (2013.01); *B24D 13/20* (2013.01); *B24D 2201/00* (2013.01)

(58) Field of Classification Search
CPC ..... B24D 13/14; B24D 13/142; B24D 13/18; B24D 18/0045; B24D 18/0072
See application file for complete search history.

(56) References Cited

U.S. PATENT DOCUMENTS

| | | | | | |
|---|---|---|---|---|---|
| 2,405,524 | A * | 8/1946 | Sharpe | B24D 13/02 | 451/532 |
| 2,690,632 | A * | 10/1954 | Sevick | B24D 5/10 | 451/544 |
| 3,136,100 | A * | 6/1964 | Robertson, Jr. | B24D 7/16 | 156/910 |
| 3,500,592 | A * | 3/1970 | Harrist | B24D 7/16 | 451/508 |
| 3,667,169 | A | 6/1972 | MacKay, Jr. | | |
| 3,844,072 | A | 10/1974 | Haigh et al. | | |
| 3,867,795 | A * | 2/1975 | Howard | C09K 3/1409 | 451/544 |
| 4,062,153 | A * | 12/1977 | Malm | B24D 5/066 | 451/544 |
| 4,951,423 | A * | 8/1990 | Johnson | B24D 7/02 | 451/510 |
| 5,259,147 | A * | 11/1993 | Falz | C09K 3/1418 | 428/148 |
| 5,269,874 | A * | 12/1993 | Winter | B24D 13/12 | 15/3.53 |
| 6,007,415 | A | 12/1999 | Van Osenbruggen | | |
| 9,321,149 | B2 * | 4/2016 | Van | B24D 7/14 | |
| 2005/0202768 | A1 | 9/2005 | Keuler | | |
| 2007/0010184 | A1 | 1/2007 | Stein et al. | | |
| 2011/0045750 | A1 | 2/2011 | Stuckenholz et al. | | |
| 2013/0344783 | A1 | 12/2013 | Zaech et al. | | |

FOREIGN PATENT DOCUMENTS

| | | | |
|---|---|---|---|
| DE | 29802791 | U1 | 4/1998 |
| DE | 202005009665 | U1 | 11/2006 |
| DE | 102009038583 | A1 | 3/2011 |
| EP | 0450209 | A1 | 10/1991 |
| EP | 0868262 | B1 | 10/1998 |
| EP | 1177071 | B1 | 2/2002 |
| EP | 2286959 | A2 | 2/2011 |
| GB | 1058502 | | 2/1967 |
| GB | 1148350 | | 4/1969 |
| WO | 9721521 | A1 | 6/1997 |
| WO | 0035634 | A1 | 6/2000 |
| WO | 2007143400 | A2 | 12/2007 |

OTHER PUBLICATIONS

English translation of the PCT International Preliminary Report on Patentability/Written Opinion dated May 26, 2016, received in corresponding PCT Application No. PCT/EP14/03013, 6 pgs.

DIN ISO 16057, Apr. 2003, with English language ANSI webpage summary, "Coated abrasives—Vulcanized-fibre discs (ISO 16057:2002)(Foreign Standard)", http://webstore.ansi.org., referenced within English specification text, p. 1, line 5 and p. 2, lines 14-18, 7 pgs total.

DIN ISO 15636 International Standard, First edition Sep. 1, 2003, "Back-up pads for vulcanized fibre discs", published in English, ISO2003, 5 pgs. total.

Handbuch Produkte und Preise (Products and Prices) 2008/2009, Lukas Erzett Vereinigte Schleif-und Fraswerkzeugfabriken GmbH & Co. KG, Engelskirchen, Germany, www.lukas-erzett.com, pp. 246, 247, 251, referenced within English specification text, p. 2, line 20 to p. 3, line 5, 5 pgs. total.

Werkzeughandbuch PFERD D21, Mar. 2009, "COMBICLICK Feberschleifer", pp. 6-7/204 and 43/204, referenced within English specification text, p. 2, lines 1-12, p. 3, lines 14-20 and p. 11, lines 6-11, 5 pgs total.

* cited by examiner

VULCANIZED FIBER GRINDING TOOL

The invention relates to a vulcanised fibre grinding tool. Vulcanised fibre grinding discs come under coated abrasives and are described in detail in DIN ISO 16057. It is possible to use paper, fabric, polyester and fibre (vulcanised fibre) as base materials for coated abrasives. These base materials enable the manufacture of grinding tools with a uniform distribution of abrasive grains comprising a wide variety of grain sizes and abrasives. Of all the base materials that can be used, vulcanised fibre is the one with the greatest strength and hardness.

Since the base material of the coated abrasive is flexible, such abrasives are also called flexible abrasives. When such grinding tools are used in sheet form, applications which involve grinding with machines require the use of a supporting base part, conventionally in the form of a so-called backing pad, as standardised in DIN ISO 15636.

In contrast to this are grinding tools with a bonded grain, also known as bonded abrasives, in which the abrasive grains are embedded in a synthetic resin mass. These grinding tools are used in the form of grindstones and grinding discs for shaping and machining the surfaces of workpieces. Such grinding tools are rigid which, on the one hand, makes it easier to generate a surface contour, but is linked to the problem that relatively large fractions of the abrasive grain can break away in uncontrolled manner, thereby resulting in an uneven grinding pattern on the surface of the workpiece.

Vulcanised fibre grinding discs are very popular in industrial applications because, of the coated abrasives, they offer the best strength with good elasticity and are therefore notable for their relatively long service life, good abrasion rate and very good grain adhesion. They are particularly suitable for generating a uniform surface structure on a workpiece. The hitherto known vulcanised fibre grinding discs should be used with a backing pad, see for example the instructions for use in the PFERD tool manual, D 21, page 6/204 and 7/204. The PFERD tool manual, D 21, can be obtained from the company August Rüggeberg GmbH & Co. KG, Marienheide, Germany.

Vulcanised fibre grinding discs can be constructed either with a central hole according to form A2—DIN ISO 16057—this is the style preferred in the USA—or with slots arranged additionally in a star shape according to form A1—DIN ISO 16057; this is the style preferred in Europe.

For vulcanised fibre grinding discs of this type, there are essentially two known and popular systems for fastening the grinding disc to a backing pad. Within Europe, it is more common to place the vulcanised fibre grinding disc over a threaded bolt, which projects beyond the backing pad on the workpiece side, and to secure it with a disc-shaped fastening element. Either the disc-shaped element itself has an internal thread and is screwed directly to the bolt or it is screwed on via a separate nut. To reduce damage to the surface, the threaded bolt and fastening element are arranged in a central depression in the backing pad, i.e. they are "counter-sunk". In an arrangement of this type, the above-mentioned slots in the grinding disc are advantageous. This type of fastening is described in more detail for example in GB 1058502 A1 and is known from the manual Produkte und Preise [Products and Prices] 2008/2009 from LUKAS-ERZETT Vereinigte Schleif-und Fräswerkzeugfabriken GmbH & Co. KG, Engelskirchen, Germany, pages 246, 247, 251.

Within America, it is common to press or punch a threaded steel ring centrally into the vulcanised fibre disc so that the disc can be fastened to the backing pad more quickly. An arrangement of this type is described for example in U.S. Pat. No. 3,667,169 A. The design with the central hole is advantageous for this.

It is generally known that these conventional methods for fastening a grinding disc onto a backing pad require a minimum setting angle of the grinding disc to the workpiece of approximately 15° in order to prevent the fastening element from coming into contact with the workpiece and to therefore prevent damage to the surface of the workpiece, see PFERD tool manual, D 21, page 6/204.

Since the conventional backing pads are made of rubber or a sufficiently elastic rubber-like plastic material, there is a risk, associated with their high abrasion rate, that the vulcanised fibre discs will overheat. As a solution to this, EP 1 741 515 A1 describes a backing pad which has a plurality of cooling channels, which are intended to ensure cooling of the grinding disc on the rear side. This furthermore describes a quick-change holder for the disc on the support pad, which comprises a special flange device which should be adhered to the rear side of the grinding disc, which is not provided with adhesive.

DE 20 2009 011470 U1 and DE10 2009 038583 A1 explain in addition how the solution described in EP 1 741 515 A1 is substantially suitable for fine machining using vulcanised fibre grinding discs with a fine grain size. When coarse grain sizes are used for rough grinding, there is a risk that the support layer, i.e. the base material of the vulcanised fibre grinding disc, will tear. As a solution, it is proposed to provide a support pad consisting of glass fibres which are impregnated with phenolic resin and compressed in conventional manner and to fasten the vulcanised fibre grinding disc to this support pad by means of an adhesive layer, with the grinding disc projecting a few millimetres beyond the support pad in a preferred embodiment. On the rear side of the support pad, which faces away from the grinding side, a metal ring should furthermore be provided to receive a drive shaft of a drive machine.

U.S. Pat. No. 3,844,072 A discloses an elastic grinding tool which is coated with an abrasive on both sides and comprises an inner disc made of plastic or metal to which there is adhered, on each side, a respective disc made from a porous foam material to which there is again adhered, on the outside in each case, a further disc of a more solid material to which there is finally adhered, on the outside in each case, a grinding disc, for example of sandpaper. The inner disc here comprises conventional connecting means for connection to a machine. The grinding tool is said to be rendered particularly useful through a simple turn of the machine due to it being equipped with a grinding disc on both sides. The elasticity is achieved through the discs being made of a porous foam material. The grinding tool should be used on a machine shaft with a backing pad of plastic material. It is further proposed, instead of a construction comprising a plurality of disc-shaped layers, to provide a stable plastic core made from a thermoplastic and to coat this with a foam material on which the cover layers are to be adhered for the purpose of receiving the grinding discs. The use of a relatively hard core is said to eliminate the need for an external backing pad.

EP 0 450 209 B1 and DE 690 07 467 T2 disclose a flexible, non-bonded double-sided disposable grinding disc for rotatable connection to a supporting element. The grinding disc disclosed therein is said to have a circular reinforcing device in the form of an intermediate part between the grinding surfaces, which defines a central opening and has two opposing, substantially circular planar surfaces. The grinding disc is intended to be removably connectable to the supporting element by means of the reinforcing device so that both grinding surfaces can be used for finishing an object. The device which can be connected to the connecting device at one end of a supporting element should advantageously have an intermediate part which defines a central bore, is located in the central opening and is mounted on the reinforcing device, with the central bore and the central opening being coaxial to one another. Alternatively, the reinforcing device should have an intermediate part in the form of a disc with two opposing, substantially planar surfaces, or another similarly flat, planar element with two opposing, substantially parallel, disc-supporting surfaces which have a central bore. A first disc element should support an abrasive material of a desired grain size on one side, whilst a second opposing side of the disc should be fastened to the disc-supporting surface by means of any type of adhesive which is known in this context. A second disc element, which has an abrasive material with a desired grain size applied to one side, should be adherently connected to the other disc-supporting surface of the intermediate part to form a disposable grinding disc with two grinding surfaces for grinding an object. The intermediate part should preferably be made from a man-made fibre material or plastic material with a high strength or a metal such as aluminium, steel, brass, copper etc. or a similar material. It is said to be important that the material selected for the intermediate part is of sufficient strength to adequately secure the disposable grinding disc during its exposure to the grinding forces. The arrangement should optionally be used with an additional supporting or reinforcing element made of rubber or a similar material. It is particularly advantageous if different specified grain sizes can be combined on both sides of the grinding tool, which can then each be accessed by turning the grinding disc.

DE 1 853 136 U describes a vulcanised fibre disc which is coated with abrasive on both sides, although only a radially outer region of the grinding disc is said to be coated with the abrasive material. The disc should be fastened in conventional manner to the spindle of a machine tool. The advantage is said to lie in a saving on material, with the intention being that the disc is turned round on the spindle for further use after the abrasive material on one side has been used.

DE 20 2010 012 502 U1 discloses a grinding disc with a plurality of holes for suctioning abrasive dust. The disc is intended for use on a backing pad in conventional manner. The backing pad here should have holes for suctioning adhesive dust. The document describes a pattern of radius lines and hole circles with a particular distribution of circular holes. The distribution of the holes is intended to always attain a virtually uniform suction performance irrespective of the relative rotatory positioning of the backing pad and grinding disc. This is intended to prevent a time-consuming relative alignment of the grinding disc and backing pad when the grinding discs are changed regularly.

Alternatively to this, WO 2007/143400 A2 describes a grinding disc for use with a likewise-described backing pad for use on a grinding machine with a suction device, wherein elongated holes or slots should be provided in the grinding disc. The slots or elongated holes can also be curved. The elongated holes should have a uniform width over their length. Furthermore, in the case of the linear and curved elongated holes shown, the end centre points of an elongated hole are located on a common radius line. As a result of this proposed design of the suction holes in the grinding disc, it should also be achieved that a virtually uniform suction performance can always be realised irrespective of the relative rotatory positioning of the backing pad and grinding disc.

Various disadvantages when using vulcanised fibre grinding discs, such as poor heat dissipation in the case of fine grain sizes, the risk of tear when working with coarse grain sizes, the need for a backing pad, a necessary minimum setting angle when machining to prevent damage to the surface, the risk of contact between the workpiece and the backing pad when grinding narrow grooves and the change-over time for the tool in relation to the operating life for industrial applications, have been treated in the prior art and a plurality of possible solutions have been proposed, which in turn are generally linked to new problems or at least incur considerable costs. The object on which the invention is based, therefore, is to provide an improved vulcanised fibre grinding tool which reduces the disadvantages known from the prior art.

This object is achieved according to the invention by a vulcanised fibre grinding tool having two vulcanised fibre grinding discs, which are adhered to one another over the entire surface by means of an adhesive layer arranged between the vulcanised fibre grinding discs so that the outer sides of the vulcanised fibre grinding discs, which are provided with the abrasive, face away from one another.

The applicant has discovered in surprising manner that, with the inventive construction of a vulcanised fibre grinding tool, the otherwise-established risk of the vulcanised fibre grinding discs tearing is, as far as possible, eliminated. Since the vulcanised fibre grinding tool according to the invention can be used on both sides, this resistance to tearing is achieved at much more favourable expense when compared to the known solutions.

The solution according to the invention has shown itself in further unexpected manner to be sufficiently stable without the use of an additional backing pad. By dispensing with a separate backing pad, the user is faced with lower overall tool costs, and the weight when used on hand-held tools is also lower. Dispensing with the additional backing pad furthermore improves the dissipation of heat.

Finally, the solution according to the invention also enables the machining of surfaces in narrow grooves owing to the omission of the backing pad and the very narrow thickness. By means of the vulcanised fibre grinding tool according to the invention, it is not only possible to achieve substantially narrower grooves than with the known tools, but the risk of a backing pad coming into contact with a side of the groove, and therefore damaging the workpiece, is also eliminated in the case of wider grooves.

The tool according to the invention can be fastened exceptionally simply to a machine tool spindle by means of a central hole in conventional manner, e.g. with a washer and nut, and this therefore results in pure material waste when the tool becomes worn. It is also possible to furthermore embed a driver element in the adhesive layer in a central region of the vulcanised fibre grinding tool to achieve quicker fastening of the vulcanised fibre grinding tool to a mechanical drive, in particular when the driver element has a mounting surface for mounting the vulcanised fibre grinding tool on the mechanical drive, with the driver element being of a depressed-centre design so that the mounting surface is arranged axially offset from a longitudinal centre plane of the vulcanised fibre grinding tool. This grinding tool according to the invention can furthermore be positioned for grinding over its entire surface on one side, which corresponds to a setting angle of 0°. This is particularly simple if only one thread is formed in the region of the mounting surface in the driver element.

It can be advantageous, particularly in conjunction with quick-change tool devices, if a driver element is furthermore arranged in a central region of the vulcanised fibre grinding tool for the purpose of connecting the vulcanised fibre grinding tool to a mechanical drive, in which case the driver element reaches through the grinding discs through a central hole and the adhered vulcanised fibre grinding discs are fastened to the driver element.

In conjunction with established hand-held machine tools, such as angle grinders, it is advantageous for a quick and simple tool change if a single- or multi-pitch screw thread or internal thread is formed in the driver element.

In a further particularly advantageous embodiment of a grinding tool according to the invention, the grinding tool has through holes arranged transversely to a longitudinal centre plane of the vulcanised fibre grinding tool. These holes enable the workpiece to be viewed during operation on the one hand and improve the dissipation of heat from the workpiece surface on the other.

It is essentially known to provide grinding tools with cutouts or openings to allow a view of the machined workpiece surface during machining of a workpiece. For example, cutouts in flap discs are disclosed in DE 20 2004 004 027 U1, US 2005 0202 768 A1, US 2006 0160 480 A1 and DE 20 2005 009 665 U1. Unlike with vulcanised fibre grinding discs, there is no need for a backing pad when using flap discs. Flap discs are another type of grinding tool in which individual abrasive sheets are adhered to a supporting plate in overlapping manner.

In combinations of supporting plates or backing pads with grinding discs, the provision of holes in the grinding disc and backing pad or supporting plate is described for example in DE 29 802 791 U1, U.S. Pat. No. 6,007,415 A, EP 0 868 262 B1, DE 696 11 764 T2, DE 699 07 280 T2, WO 00/35634 A and WO 97/21521 A.

The Pferd D21 tool manual, page 43/204, describes grinding discs and matching backing pads with holes. However, in machines which are equipped accordingly, these holes are intended to serve for suctioning abrasive dust during the grinding process in order to delay the grinding disc in becoming clogged.

All these described constructions having a backing pad are particularly disadvantageous in that, when the grinding disc is changed, the new grinding disc has to be positioned with its holes in alignment with the holes in the support plate or backing pad. Taking into account the constructions in DE 20 2009 011 470 U1, in which the operating life of such grinding discs in industrial applications is sometimes less than a minute, the tool change times for the total machining period take on extreme economic significance. When compared to the known solutions, the construction according to the invention is linked to an enormous economical advantage for the user of such a tool according to the invention.

It is further known from DT 2 121 842 OS to provide cutouts and slots in a grinding disc, in which the abrasive is adhered to a thin metal support disc. The disc described is said to be especially suitable for machine finishing cutting tools. As a result of the cutouts and slots also having a special design, a predetermined edge breaking zone is said to be formed which is intended to enable the disc to be used multiple times with a reduced radius. It is known from DT 1 652 912 OS to provide cutouts in grinding discs, wherein the cutouts are to be restricted to an edge region in which the grinding disc is not supported by a backing pad.

For a better view of the workpiece surface, it is advantageous if the through holes are located on one or more hole circles arranged concentrically to an axis of rotation of the vulcanised fibre grinding tool.

It has been shown to be particularly advantageous if the through holes have an elongated form, with the length of the through holes preferably being at least three times the greatest width of the through holes, in particular if the width of the elongated through holes decreases from a first end portion of a through hole to a second end portion of the through hole and the first end portion preferably has a larger radial spacing from an axis of rotation of the vulcanised fibre grinding tool than the second end portion. This improves the view of the essential parts of the workpiece surface to be machined on the one hand and at the same time achieves an improved dissipation of heat from the workpiece surface. The first end portion and the second end portion of a through hole here are preferably arranged on different radius lines about the axis of rotation of the vulcanised fibre grinding tool. The angle formed here by the radius lines of a through hole about the axis of rotation in the longitudinal centre plane of the vulcanised fibre grinding tool is particularly advantageously at least 30°, preferably not more than 60°.

In a further preferred embodiment, the grinding tool is simply constructed as a segment-like part of a disc. This enables the grinding tool according to the invention to also be particularly advantageously combined with so-called multi-tools, which have a rotatory oscillating drive for the tool and are otherwise designed similarly to an angle grinder, and to be used for precise surface machining.

Figure 2:
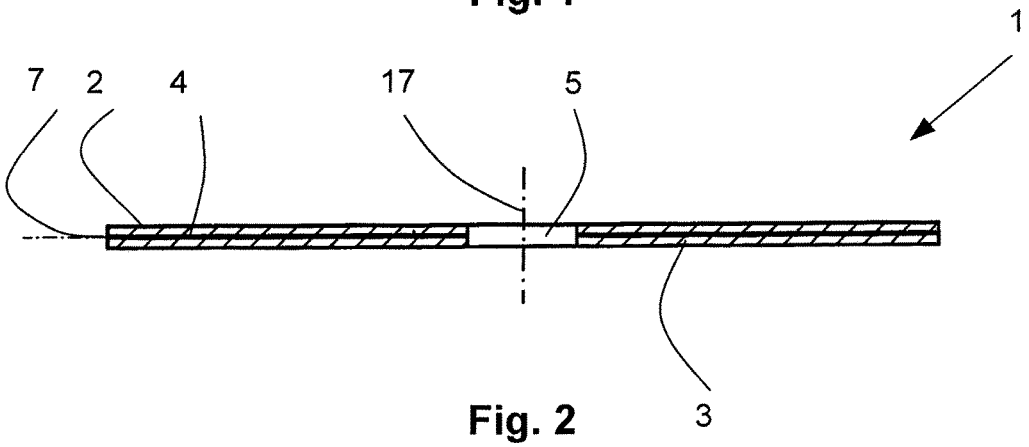
Figure 3:
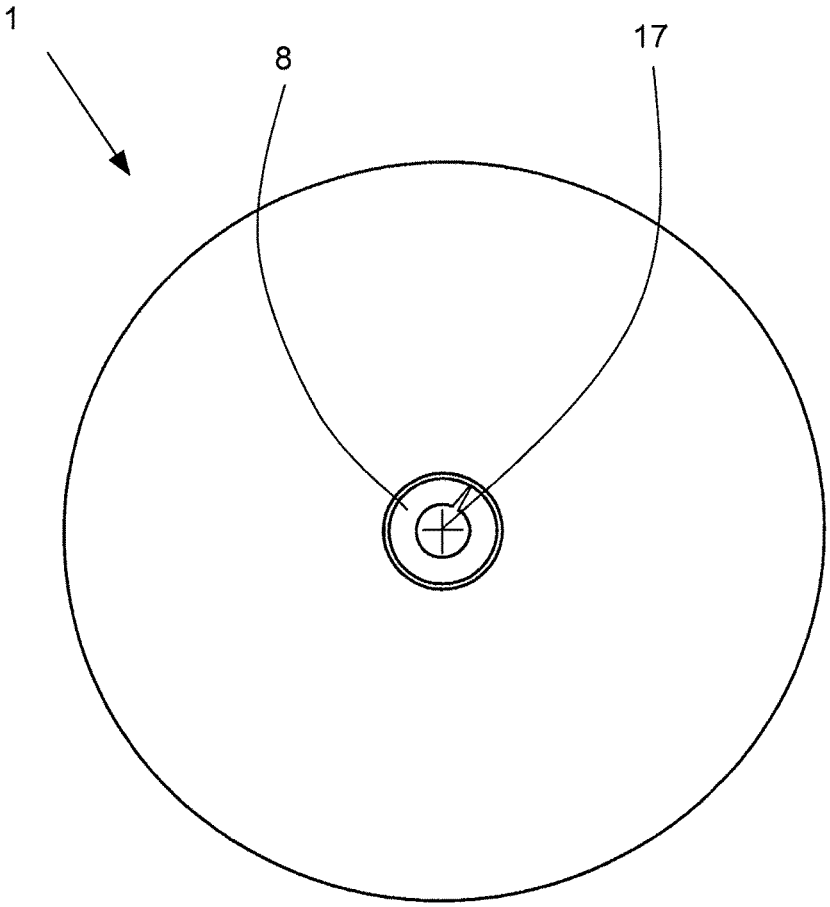
Figure 4:
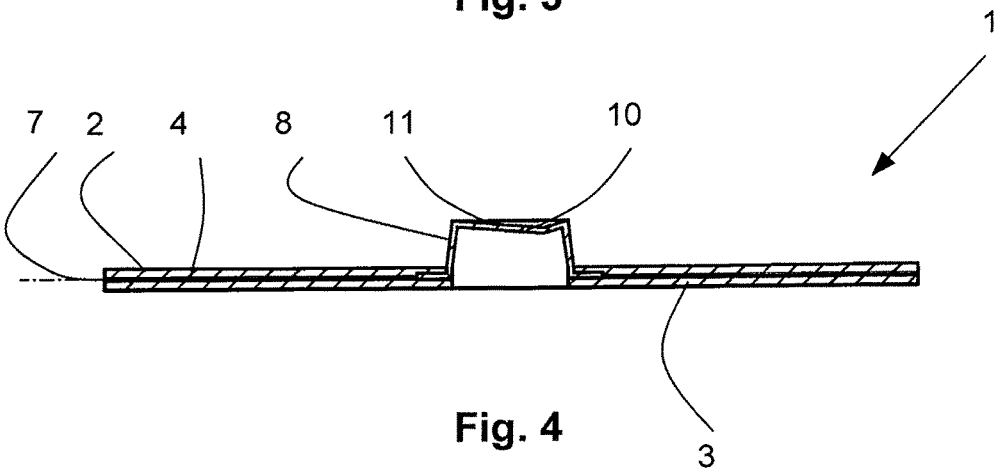
Figure 5:
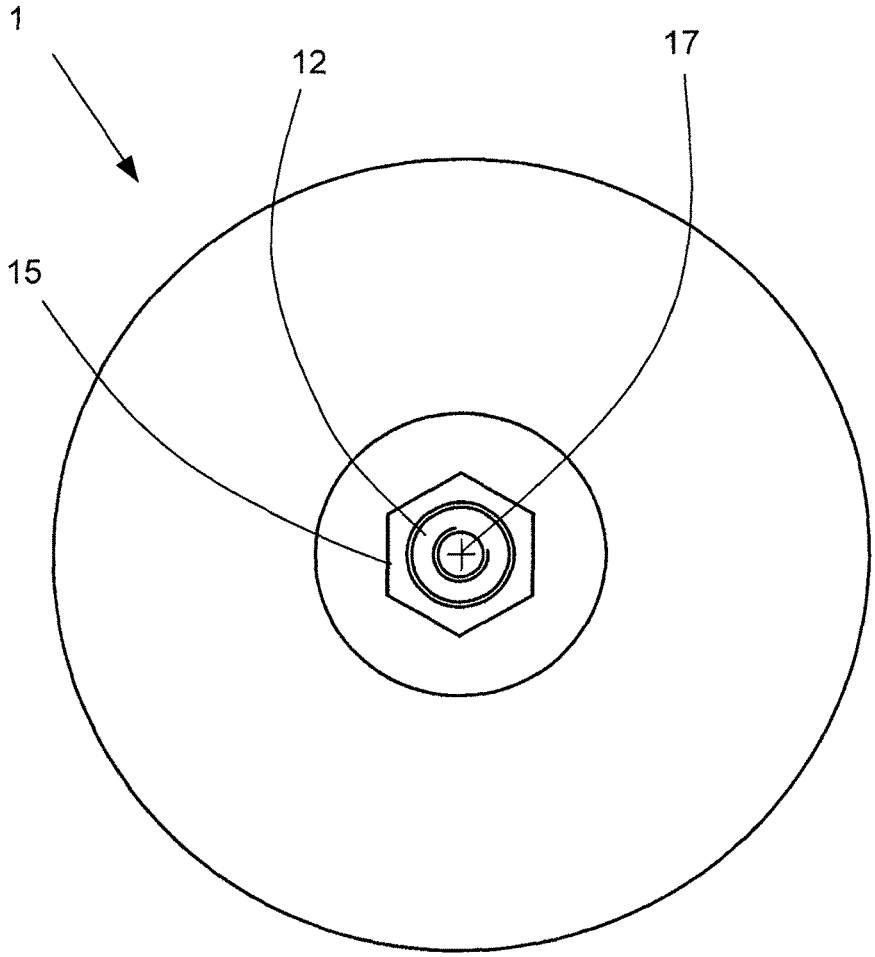
Figure 6:
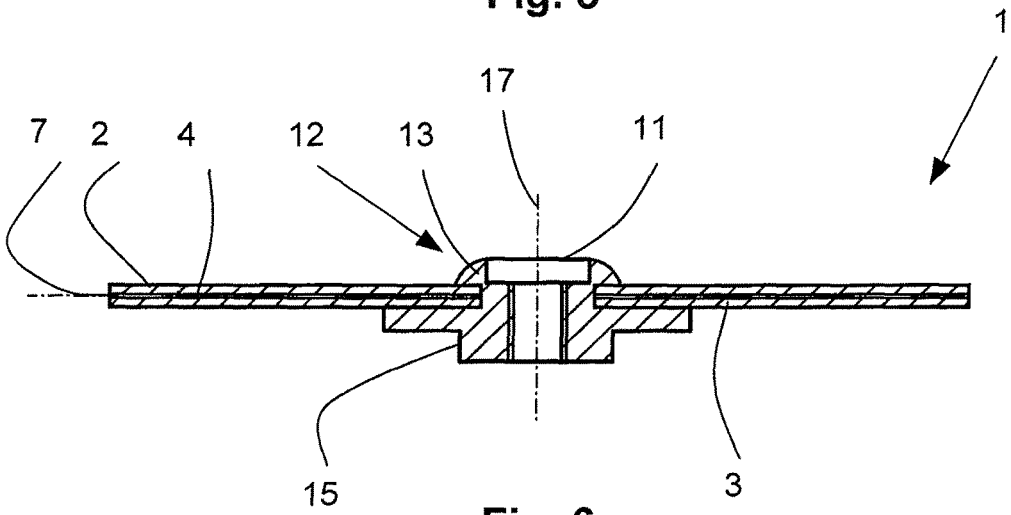
Figure 7:
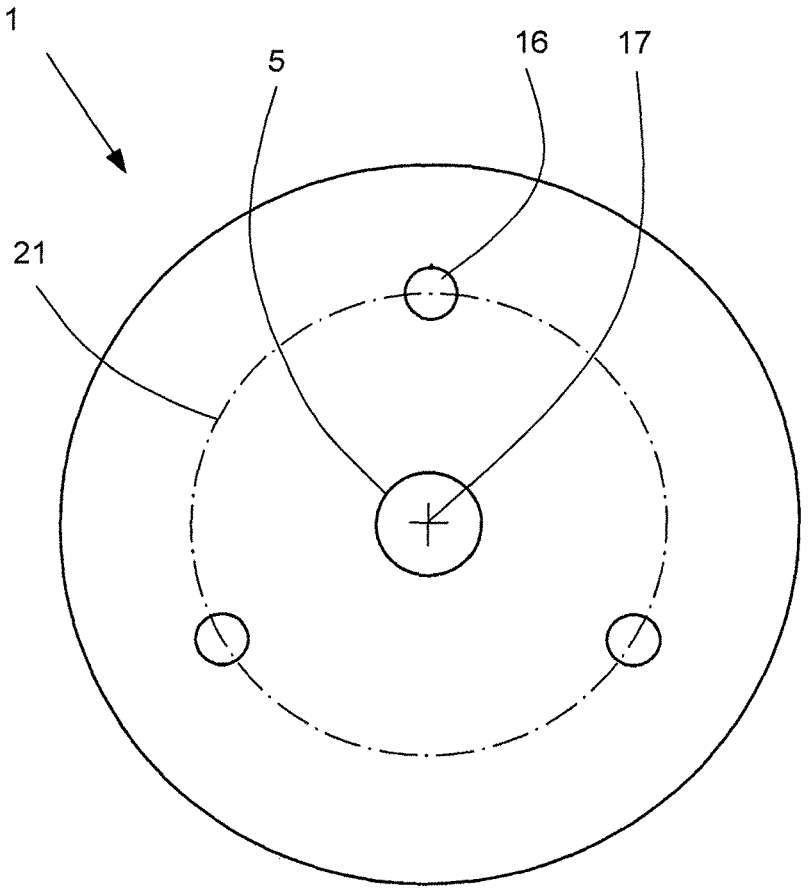
Figure 8:
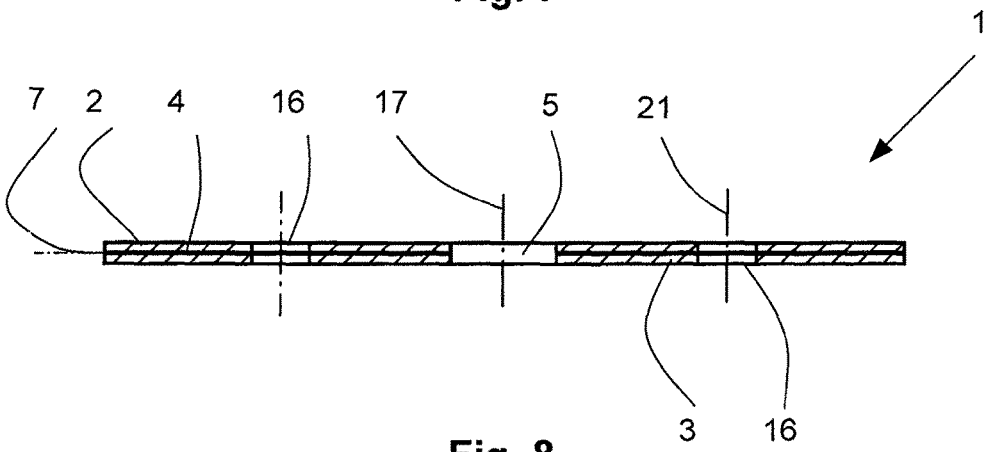
Figure 9:
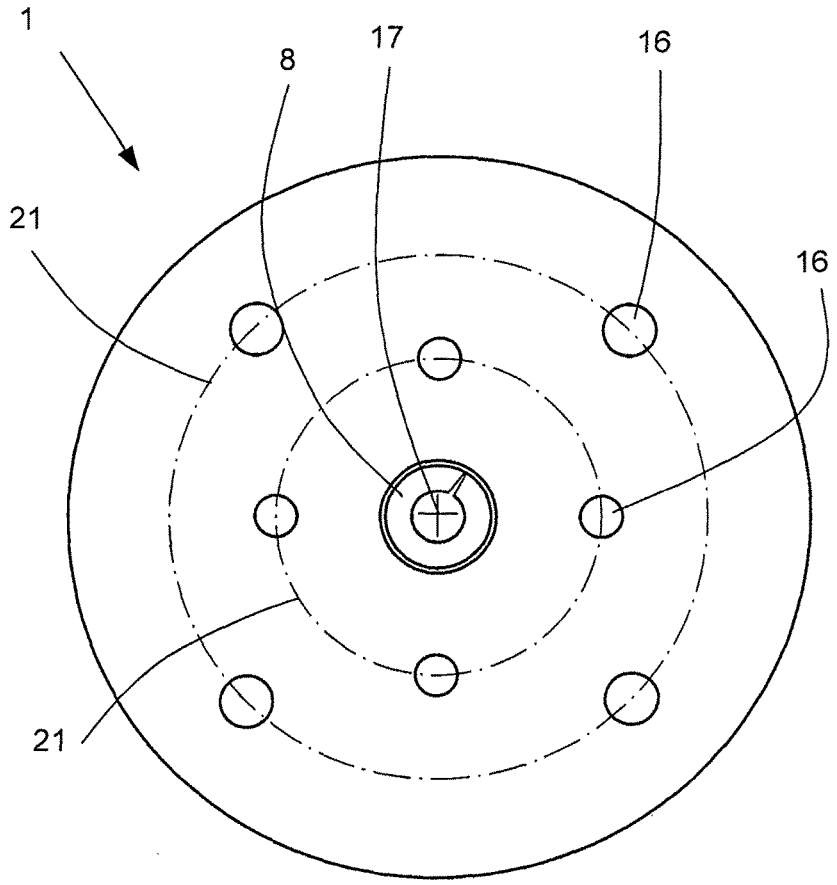
Figure 10:
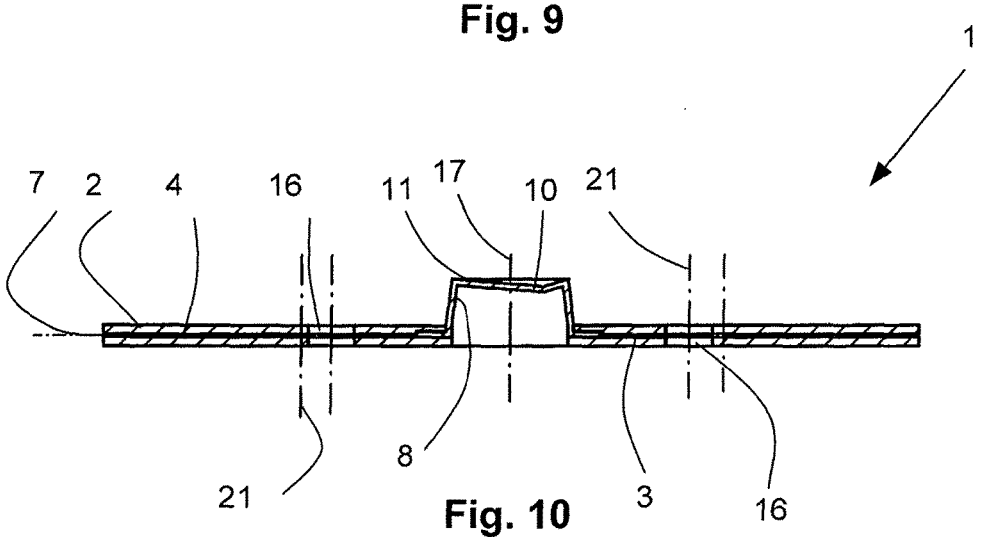
Figure 11:
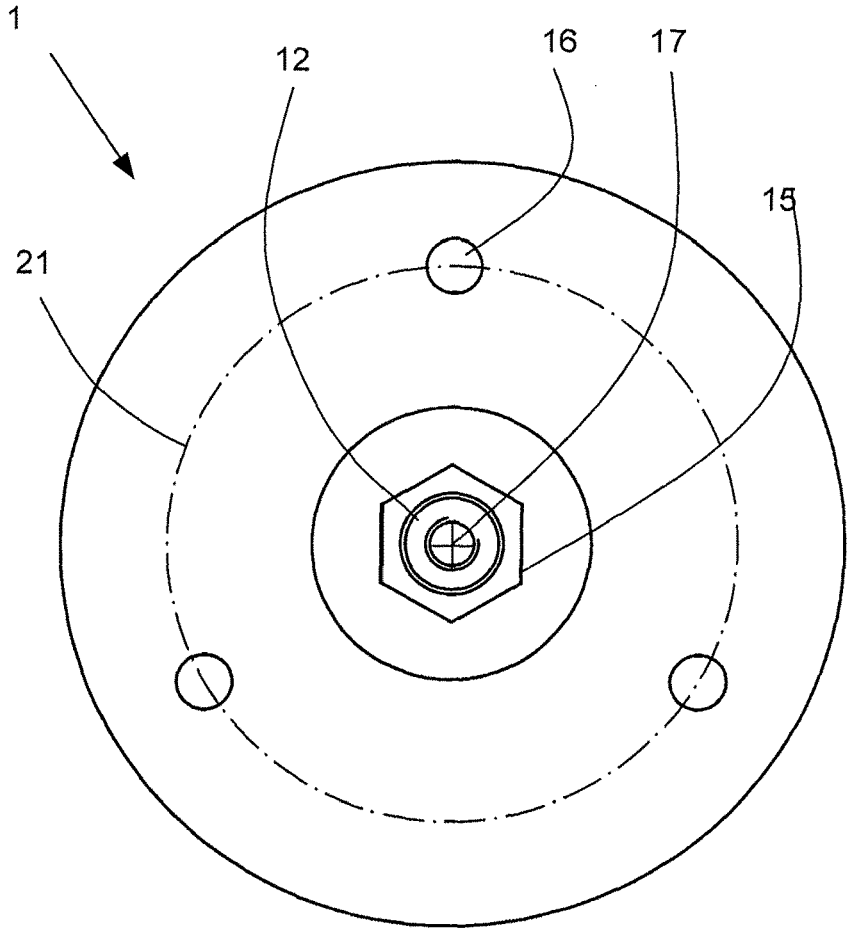
Figure 12:
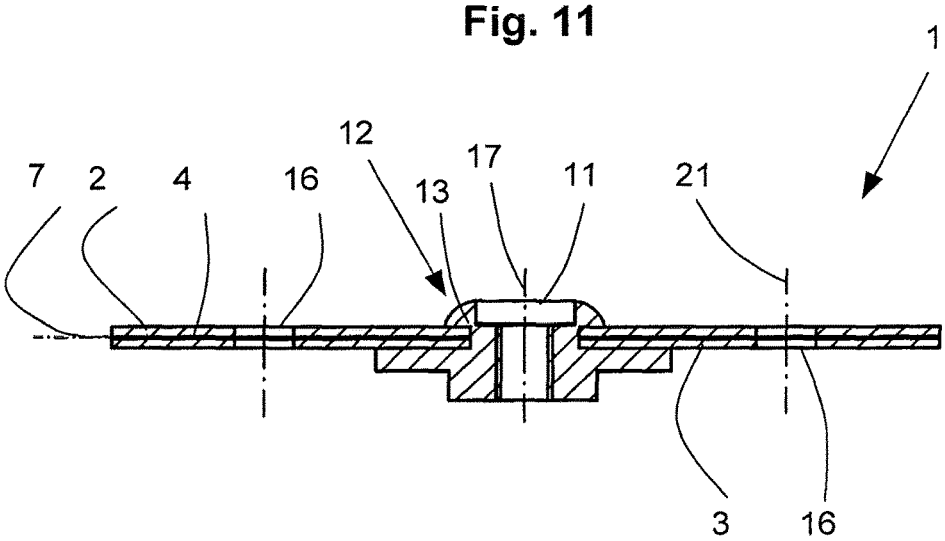
Figure 13:
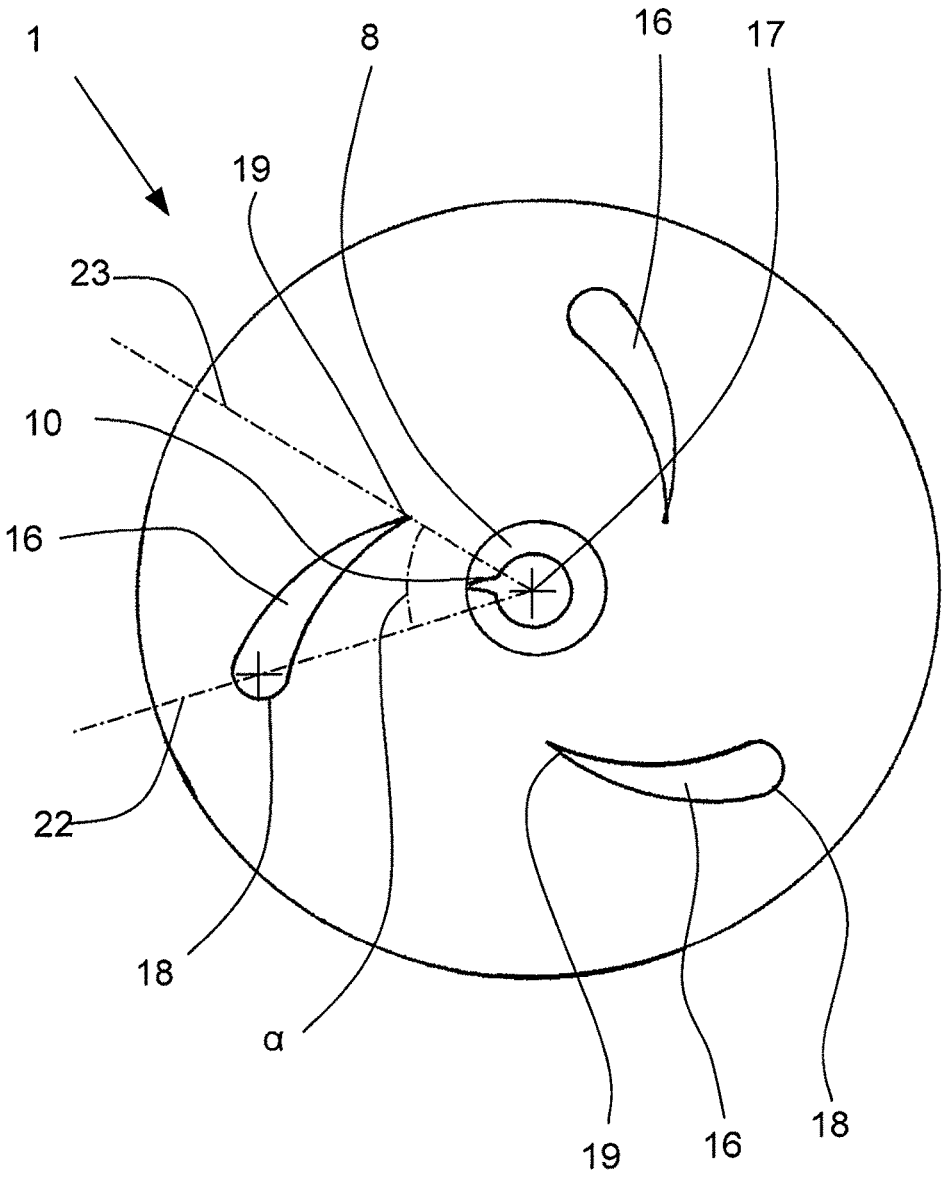
Figure 14:
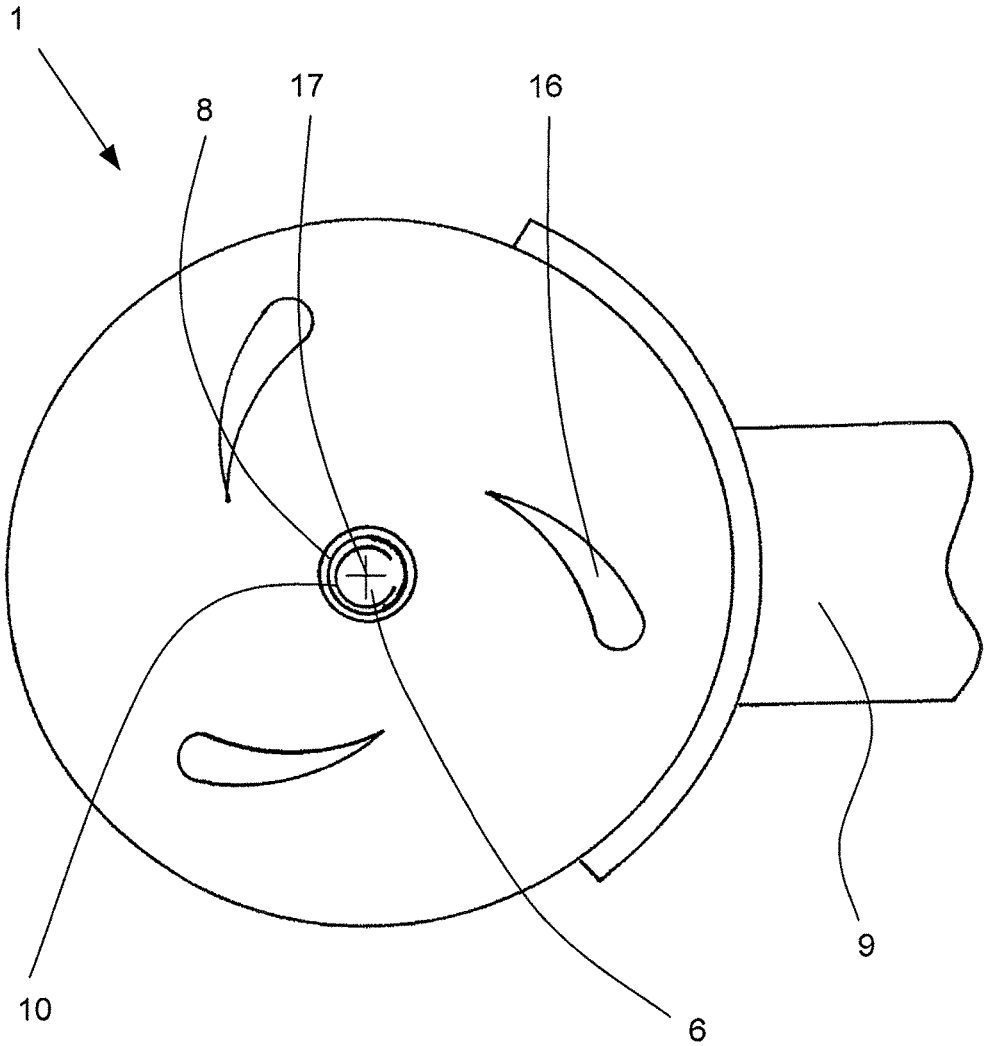
Figure 15:
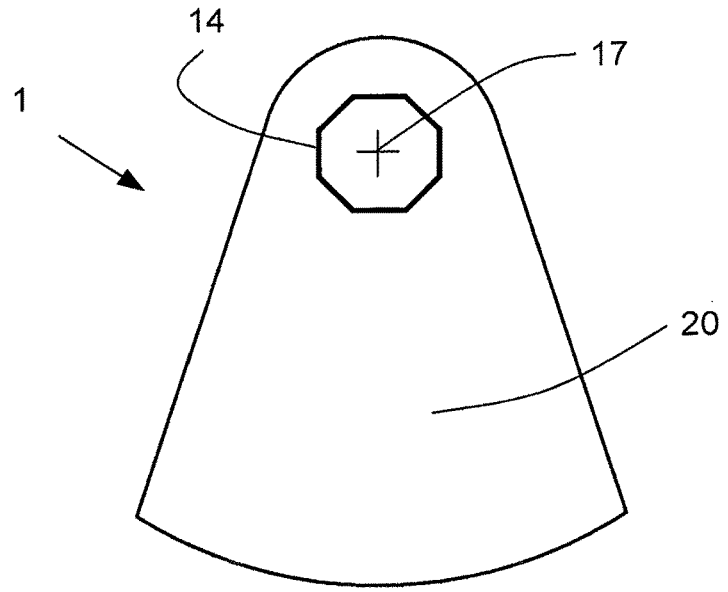
Figure 16:
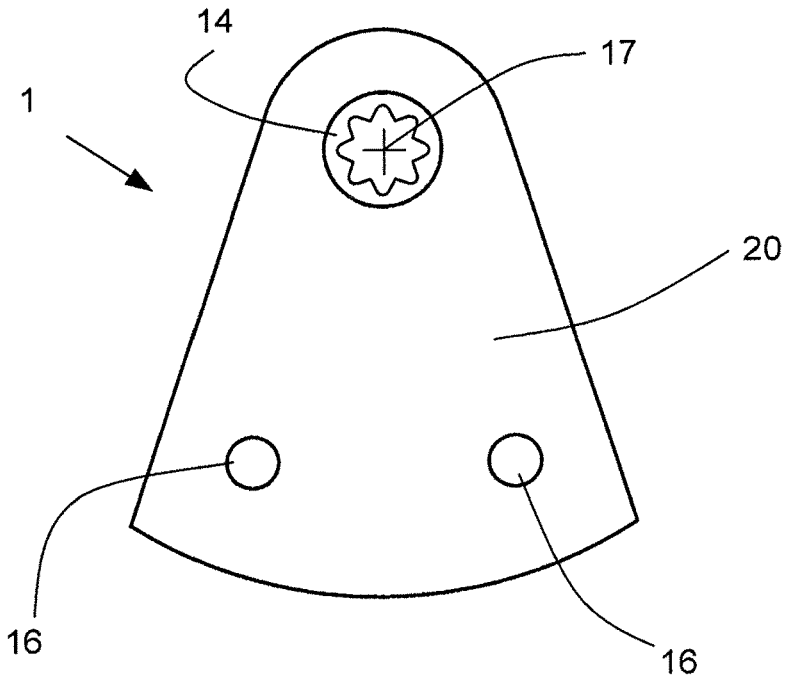

The invention will be explained in more detail below with reference to exemplary embodiments and with the aid of the accompanying drawings, which show:

FIG. 1 a first embodiment of an inventive vulcanised fibre grinding tool, in plan view;

FIG. 2 the inventive vulcanised fibre grinding tool of FIG. 1, in cross-section;

FIG. 3 a second embodiment of an inventive vulcanised fibre grinding tool, in plan view;

FIG. 4 the inventive vulcanised fibre grinding tool of FIG. 3, in cross-section;

FIG. 5 a third embodiment of an inventive vulcanised fibre grinding tool, in plan view;

FIG. 6 the inventive vulcanised fibre grinding tool of FIG. 5, in cross-section;

FIG. 7 a fourth embodiment of an inventive vulcanised fibre grinding tool, in plan view;

FIG. 8 the inventive vulcanised fibre grinding tool of FIG. 7, in cross-section;

FIG. 9 a fifth embodiment of an inventive vulcanised fibre grinding tool, in plan view;

FIG. 10 the inventive vulcanised fibre grinding tool of FIG. 9, in cross-section;

FIG. 11 a sixth embodiment of an inventive vulcanised fibre grinding tool, in plan view;

FIG. 12 the inventive vulcanised fibre grinding tool of FIG. 11, in cross-section;

FIG. 13 a seventh embodiment of an inventive vulcanised fibre grinding tool in plan view;

FIG. 14 the inventive vulcanised fibre grinding tool of FIG. 13 on an angle grinder;

FIG. 15 a further embodiment of an inventive vulcanised fibre grinding tool as a segment-like part of a disc; and FIG. 16 a modification of the embodiment of an inventive vulcanised fibre grinding tool of FIG. 15.

The inventive vulcanised fibre grinding disc illustrated in the drawings is provided and designed to be driven in rotatory or rotatory oscillating manner, for example for a conventional angle grinder. The inventive vulcanised fibre grinding tool illustrated in the figures (denoted as a whole by 1) comprises two vulcanised fibre grinding discs 2 and 3, which are provided with an abrasive at least on one of their outer sides and are adhered to one another over the entire surface by means of an adhesive layer 4 arranged between the vulcanised fibre grinding discs 2, 3, so that the outer sides of the vulcanised fibre grinding discs 2, 3, which are provided with the abrasive, face away from one another. The adhesive layer 4 can be formed for example by an epoxy resin based adhesive.

The first embodiment (shown in plan view in FIG. 1 and in cross-section in FIG. 2) of a vulcanised fibre grinding tool 1 according to the invention can be fastened exceptionally simply to a machine tool spindle 6 by means of a central hole 5 in conventional manner, e.g. with a washer and nut. This therefore results in pure material waste when the tool 1 becomes worn, which means that disposal is kept simple and disposal costs are therefore kept low, particularly when used on an industrial scale. The hole 5 is advantageously designed as a hole with a nominal diameter of 22.23 mm. As a result of the symmetrical construction of the grinding tool 1, the longitudinal centre plane 7 of the grinding tool 1 is located in the adhesive layer 4.

As is clearly shown in FIG. 4, that embodiment of a grinding tool 1 according to the invention which is illustrated in FIGS. 3 and 4 furthermore has, in a central region of the vulcanised fibre grinding tool 1, a driver element 8 embedded in the adhesive layer 4 for the purpose of connecting the vulcanised fibre grinding tool 1 to a mechanical drive, for example a machine tool spindle 6 of an angle grinder 9, as shown in FIG. 14. The driver element 8 shown is advantageously manufactured as a metal pressed part and has an M14 or ⅝-11" thread pitch 10 integrally formed therein, as is also clearly shown in FIGS. 13 and 14. The grinding tool can therefore be screwed directly onto the machine tool spindle 6 of the angle grinder 9, which shortens the tool change times considerably and therefore improves the overall cost-effectiveness when using a grinding tool 1 according to the invention.

A mounting surface 11 for mounting the vulcanised fibre grinding tool 1 on the mechanical drive, for example on a shaft collar or on a machine tool spindle 6 or a spacer block, is furthermore constructed on the driver element 8. To this end, the driver element 8 is of a depressed-centre design so that the mounting surface 11 is arranged axially offset from the longitudinal centre plane 7 of the vulcanised fibre grinding tool 1, as shown particularly clearly in FIG. 4. With an appropriately adapted thread length of the machine tool spindle 6 or the use of suitable spacer blocks so that the machine tool spindle 6 does not project beyond the mounting surface 11 on the side of the vulcanised fibre grinding tool 1 which is opposite this mounting surface, the grinding tool 1 according to the invention can be positioned for grinding over its entire surface on the side of the vulcanised fibre grinding tool 1 which is opposite to the mounting surface 11.

In the embodiment of an inventive vulcanised fibre grinding tool 1 shown in FIGS. 5 and 6, another driver element 12 is arranged in the central region of the vulcanised fibre grinding tool 1 for the purpose of connecting the vulcanised fibre grinding tool 1 to a mechanical drive 6. This commercially available driver element 12 is adhered and fixedly clamped to the vulcanised fibre discs. A hexagon bolt 15 is integrally formed on a hub body 13 for the purpose of positioning a conventional tool when it is fastened or released from a drive spindle 6. A single-pitch, preferably multi-pitch, screw thread or internal thread is constructed in the hub body 13 as part of a quick-change fastening of the grinding tool 1 on a drive spindle 6.

FIGS. 7 to 12 show embodiments of a grinding tool 1 according to the invention, which correspond to those in FIGS. 1 to 6 and which additionally have through holes 16 arranged transversely to the longitudinal centre plane 7 of the vulcanised fibre grinding tool 1. The through holes 16 are located on one (FIGS. 7, 8, 11, 12) or more (FIGS. 9, 10) hole circles 21 arranged concentrically to an axis of rotation 17 of the vulcanised fibre grinding tool 1. The number of through holes 16 can be 2, 3, 4, 5, 6, 7, 8, 9 or more, the through holes 16 should be arranged in a uniform distribution to avoid an imbalance of the grinding tool 1.

In the embodiments of a grinding tool 1 according to the invention which are shown in FIGS. 13 and 14, the through holes 16 have an elongated, drop-shaped, trailing form, with the length of the through holes 16 preferably being at least three times the greatest width of the through holes 16. The width of the elongated through holes 16 furthermore decreases from a first end portion 18 of a through hole 16 to a second end portion 19 of the through hole 16. The first end portion 18 has a larger radial spacing from the axis of rotation 17 of the vulcanised fibre grinding tool 1 than the second end portion 19. The through holes 16 of these embodiments have a shape such as that often used to illustrate a comet with a tail. As shown, the elongated through holes 16 can have an intrinsically curved construction. The operator has a larger view of the total machining surface than is the case with circular through holes. It has proven advantageous for the end portion 18 to be arranged closer to the outer edge of the vulcanised fibre grinding tool 1 and the narrower second end portion 19 to be arranged closer to the axis of rotation 17. The first end portion 18 and the second end portion 19 of a through hole 16 are arranged here on different radius lines 22, 23 about the axis of rotation 17 of the vulcanised fibre grinding tool 1. The angle $\alpha$ formed by the radius lines 22, 23 of a through hole 16 about the axis of rotation 17 in the longitudinal centre plane 7 of the vulcanised fibre grinding tool 1 is at least 30°, preferably not greater than 60°, in the embodiment shown approximately 40° to 45°.

FIGS. 15 and 16 show further embodiments of a vulcanised fibre grinding tool 1 according to the invention, which is constructed as a segment-like part 20 of a disc for use with so-called multi-tools, which have a rotatory oscillating drive for the tool 1 and are otherwise of a similar design to an angle grinder 9 and can be used for fine and precise surface machining. As a result of the rotatory oscillating movement of the machine tool spindle 6, a driver element 14 with a form-fitting holder for the machine tool spindle 6 is advantageous. A hexagonal hole, as shown in FIG. 15, or an octuple star, as shown in FIG. 16, enable the vulcanised fibre grinding tool 1 to be connected to the machine tool spindle 6 in various basic positions depending on the most expedient positioning of the machine tool in relation to the workpiece. Such a vulcanised fibre grinding tool 1 in the form of a segment can also have through holes 16 with the advantages described above. An embodiment of this type is shown in FIG. 16. It goes without saying that such a vulcanised fibre grinding tool 1 with holes 16 in FIG. 16 can also be equipped with a driver element 14, as shown in FIG. 15, and vice versa. The through holes 16 can also have the elongated form and the arrangement described with reference to FIG. 13.

LIST OF REFERENCE SYMBOLS

1 Vulcanised fibre grinding tool, as a whole
2 Vulcanised fibre grinding disc
3 Vulcanised fibre grinding disc
4 Adhesive layer
5 Central hole
6 Machine tool spindle
7 Longitudinal centre plane
8 Driver element
9 Angle grinder
10 Thread pitch
11 Mounting surface
12 Driver element
13 Hub body
14 Driver element
15 Hexagon bolt
16 Through hole
17 Axis of rotation
18 First end portion
19 Second end portion
20 Segment-like part
21 Hole circle
22 Radius line
23 Radius line
α Angle

What is claimed is:

1. A vulcanised fibre grinding tool, comprising:

two vulcanised fibre grinding discs each having an inner side and an outer side, the inner side of each of the vulcanised fibre grinding discs adhered to one another over an entire surface thereof by an adhesive layer arranged between the vulcanised fibre grinding discs, the outer side of each of the vulcanised fibre grinding discs, which face away from one another, include an abrasive, a driver element embedded in the adhesive layer in a central region of the vulcanised fibre grinding tool, and the driver element is configured to connect the vulcanised fibre grinding tool to a mechanical drive.

2. The vulcanised fibre grinding tool according to claim 1, wherein:

the vulcanised fibre grinding tool has a longitudinal centre plane, the driver element has a mounting surface configured to mount the vulcanised fibre grinding tool on the mechanical drive, and wherein the driver element is of a depressed-centre design so that the mounting surface is arranged axially offset from the longitudinal centre plane of the vulcanised fibre grinding tool.

3. The vulcanised fibre grinding tool according to claim 1, wherein:

the driver element comprises a single- or multi-pitch screw thread or internal thread.

4. The vulcanised fibre grinding tool according to claim 1, wherein:

the vulcanised fibre grinding tool has a longitudinal centre plane, and the grinding tool has a plurality of through holes arranged transversely to the longitudinal centre plane of the vulcanised fibre grinding tool.

5. The vulcanised fibre grinding tool according to claim 4, wherein:

the vulcanised fibre grinding tool has an axis of rotation, and the plurality of through holes are located on one or more hole circles arranged concentrically to the axis of rotation of the vulcanised fibre grinding tool.

6. The vulcanised fibre grinding tool according to claim 4, wherein:

each through hole of the plurality of through holes is elongated and has a drop-shaped form.

7. The vulcanised fibre grinding tool according to claim 6, wherein:

each elongated through hole of the plurality of elongated through holes has a length and a width, and the width of each of the elongated through holes decreases along the length from a first end portion of the elongated through hole to a second end portion of the elongated through hole.

8. The vulcanised fibre grinding tool according to claim 7, wherein:

the vulcanised fibre grinding tool has an axis of rotation, and the first end portion of each elongated through hole of the plurality of elongated through holes has a larger radial distance from the axis of rotation of the vulcanised fibre grinding tool than the second end portion of each elongated through hole of the plurality of elongated through holes.

9. The vulcanised fibre grinding tool according to claim 8, wherein:

the vulcanised fibre grinding tool has a plurality of radius lines which each extend radially from the axis of rotation of the vulcanised fibre grinding tool, and the first end portion and the second end portion of each elongated through hole of the plurality of elongated through holes are arranged at a different radius line of the plurality of radius lines of the vulcanised fibre grinding tool.

10. The vulcanised fibre grinding tool according to claim 9, wherein:

an angle is formed by the different radius lines of each elongated through hole of the plurality of elongated through holes about the axis of rotation in the longitudinal centre plane of the vulcanised fibre grinding tool, and the angle is at least 30°.

11. The vulcanised fibre grinding tool according to claim 6, wherein:

the vulcanised fibre grinding tool has an axis of rotation, each elongated through hole of the plurality of elongated through holes has a first end portion and a second end portion, and the first end portion of each elongated through hole of the plurality of elongated through holes has a larger radial distance from the axis of rotation of the vulcanised fibre grinding tool than the second end portion of each elongated through hole of the plurality of elongated through holes.

12. A vulcanised fibre grinding tool, comprising:

two vulcanised fibre grinding discs each having an inner side and an outer side, the inner side of each of the vulcanised fibre grinding discs adhered to one another over an entire surface thereof by an adhesive layer arranged between the vulcanised fibre grinding discs, the outer side of each of the vulcanised fibre grinding discs, which face away from one another, include an abrasive, the vulcanised fibre grinding tool having a longitudinal centre plane, the grinding tool has a plurality of through holes arranged transversely to the longitudinal centre plane of the vulcanised fibre grinding tool, and each through hole of the plurality of through holes is elongated and has a drop-shaped form.

13. The vulcanised fibre grinding tool according to claim 12, wherein:

a driver element is arranged in a central region of the vulcanised fibre grinding tool to connect the vulcanised fibre grinding tool to a mechanical drive, and wherein the driver element extends through a central hole in each of the vulcanised fibre grinding discs and the vulcanised fibre grinding discs are fastened to the driver element.

14. The vulcanised fibre grinding tool according to claim 13, wherein:

the driver element comprises a single- or multi-pitch screw thread or internal thread.

15. The vulcanised fibre grinding tool according to claim 12, wherein:

the vulcanised fibre grinding tool has an axis of rotation, and the plurality of through holes are located on one or more hole circles arranged concentrically to the axis of rotation of the vulcanised fibre grinding tool.

16. The vulcanised fibre grinding tool according to claim 12, wherein:

each elongated through hole of the plurality of elongated through holes has a length and a width, and the width of each of the elongated through holes decreases along the length from a first end portion of the elongated through hole to a second end portion of the elongated through hole.

17. The vulcanised fibre grinding tool according to claim 16, wherein:

the vulcanised fibre grinding tool has an axis of rotation, and the first end portion of each elongated through hole of the plurality of elongated through holes has a larger radial distance from the axis of rotation of the vulcanised fibre grinding tool than the second end portion of each elongated through hole of the plurality of elongated through holes.

18. The vulcanised fibre grinding tool according to claim 17, wherein:

the vulcanised fibre grinding tool has a plurality of radius lines which each extend radially from the axis of rotation of the vulcanised fibre grinding tool, and the first end portion and the second end portion of each elongated through hole of the plurality of elongated through holes are arranged at a different radius line of the plurality of radius lines of the vulcanised fibre grinding tool.

19. The vulcanised fibre grinding tool according to claim 18, wherein:

an angle is formed by the different radius lines of each elongated through hole of the plurality of elongated through holes about the axis of rotation in the longitudinal centre plane of the vulcanised fibre grinding tool, and the angle is at least 30°.

20. The vulcanised fibre grinding tool according to claim 12, wherein:

the vulcanised fibre grinding tool has an axis of rotation, each elongated through hole of the plurality of elongated through holes has a first end portion and a second end portion, and the first end portion of each elongated through hole of the plurality of elongated through holes has a larger radial distance from the axis of rotation of the vulcanised fibre grinding tool than the second end portion of each elongated through hole of the plurality of elongated through holes.

* * * * *